US005716510A

United States Patent [19]

Lorento

[11] Patent Number: 5,716,510

[45] Date of Patent: Feb. 10, 1998

[54] METHOD OF MAKING A CONTINUOUS CASTING MOLD

[75] Inventor: Donald P. Lorento, Exeter, Canada

[73] Assignee: SMS Schloemann-Siemag Inc., Pittsburgh, Pa.

[21] Appl. No.: 538,624

[22] Filed: Oct. 4, 1995

[51] Int. Cl.[6] ..... C25D 5/02; C25D 5/14

[52] U.S. Cl. ..... 205/122; 164/418; 205/178; 205/180; 205/224

[58] Field of Search ..... 164/418, 459; 29/527.2; 205/118, 122, 178, 180, 224; 427/135

[56] References Cited

U.S. PATENT DOCUMENTS

| | | | |
|---|---|---|---|
| 3,295,172 | 1/1967 | Dain | 164/418 |
| 4,949,773 | 8/1990 | Nomura et al. | 164/418 X |
| 5,513,691 | 5/1996 | Langner et al. | 164/418 |

FOREIGN PATENT DOCUMENTS

| | | | |
|---|---|---|---|
| 59-223143 | 12/1984 | Japan | 164/418 |
| 2-121752 | 5/1990 | Japan | 164/459 |

*Primary Examiner*—J. Reed Batten, Jr.
*Attorney, Agent, or Firm*—Antonio R. Durando

[57] ABSTRACT

A wall of a four-piece mold is made by machining cooling channels into one side of a steel backup member. The cooling channels are filled with wax which is then covered with conductive paint or tape. A layer of copper is now electroplated onto the side of the backup member with the cooling channels, and nickel and chromium are plated over the copper in succession. Upon completion of plating, the wax is removed from the cooling channels by melting the wax. Alternatively to machining the cooling channels into the backup member, strips of plastic are adhesively secured to the backup member prior to plating. The plastic strips, which have widths and heights equal to the desired widths and depths of the cooling channels, are placed on the backup member at the intended locations of the cooling channels. Copper is plated onto the backup member to the height of the strips which are then removed to form the cooling channels. The cooling channels are filled with wax and the process of making the mold wall is then completed as before.

18 Claims, 2 Drawing Sheets

METHOD OF MAKING A CONTINUOUS CASTING MOLD

BACKGROUND OF THE INVENTION

1 . Field of the Invention

The invention relates to a mold.

2 . Description of the Prior Art

Molds for the continuous casting of steel slabs, large steel beam blanks, large steel blooms and thin steel strip are normally made up of four walls which are clamped to one another so as to define a casting passage. Each of the walls includes a steel backup member and a copper member which is bolted to the backup member.

The copper members serve to withdraw heat from a continuously cast strand travelling through the casting passage. To this end, the copper members line the casting passage and are provided with cooling channels for the circulation of water.

The copper members are made of high grade copper which is expensive. Since considerable amounts of copper are lost as waste during the formation of cooling channels in the copper members, the cooling channels increase the cost of the molds.

Furthermore, a large portion of each copper member is located on the side of the cooling channels remote from the casting passage. Not only is this wasteful because the high thermal conductivity of copper is not required in this area but the mechanical properties of copper are not well suited for such area.

SUMMARY OF THE INVENTION

It is an object of the invention to provide a method which allows the cost of material for a mold to be reduced.

Another object of the invention is to provide a method which enables a mold to be produced with smaller amounts of thermally conductive material.

An additional object of the invention is to provide a mold which permits the cost of material to be decreased.

A further object of the invention is to provide a mold which can be made with lesser quantities of thermally conductive material.

The preceding objects, as well as others which will become apparent as the description proceeds, are achieved by the invention.

One aspect of the invention resides in a method of making a mold, particularly a mold for the continuous casting of steel. The method comprises the steps of providing a heat-extracting carrier having a side adapted to face a casting passage, and plating a thermally conductive layer over at least a major portion of such side.

The heat-extracting carrier makes it unnecessary to form cooling channels in the thermally conductive layer. Hence, the thermally conductive layer can be relatively thin and can be produced using relatively small amounts of thermally conductive material.

Another aspect of the invention resides in a mold, especially a mold for the continuous casting of steel. The mold comprises a heat-extracting carrier having a side adapted to face a casting passage, and a thermally conductive layer plated onto and covering at least a major portion of this side.

Additional features of the invention will become apparent from the following detailed description of preferred embodiments when read in conjunction with the accompanying drawings.

DESCRIPTION OF THE PREFERRED EMBODIMENTS

The invention will be described with reference to the production of a mold wall constituting part of a multipartite mold for continuous casting. By way of example, multipartite molds are used to continuously cast steel slabs, steel beam blanks, steel blooms and steel strip. Such molds are made up of a number of separate mold walls, e.g., four mold walls, which are clamped to one another so as to define a casting cavity or passage.

Figure 1:
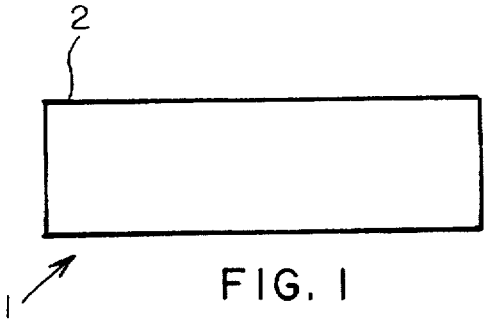
FIGS. 1–13 illustrate various stages in the production of mold walls according to the invention.

Referring to FIG. 1, the numeral 1 identifies a carrier or support which is here in the form of a generally rectangular plate but could also take other forms depending upon the type of mold to be made. The plate 1, which constitutes a backup plate of the mold wall being produced and may, for instance, be made of steel, has a major surface or side 2 which is intended to face the casting cavity.

Figure 2:
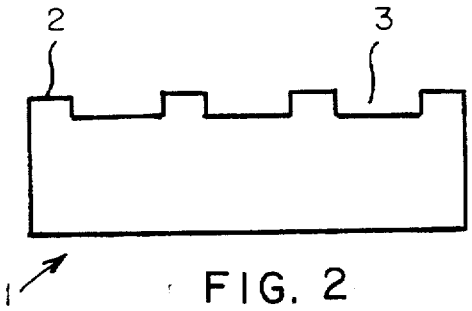

As shown in FIG. 2, longitudinal cooling channels or slots 3 are machined in the major side 2 of the backup plate 1. The cooling channels 3, which are open at the major side 2 of the backup plate 1, can be made relatively shallow and wide in order to achieve high cooling efficiency. Due to the presence of the cooling channels 3, the major side 2 of the backup plate 1 serves as a heat-extracting side of the backup plate 1, and the backup plate 1 functions as a heat-extracting backup plate.

Figure 3:
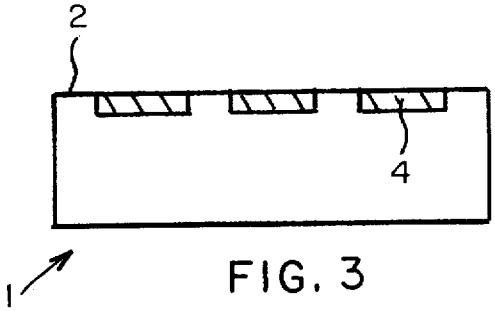

With reference to FIG. 3, each of the cooling channels 3 is filled with a filler 4. The filler 4 consists of a material which will not run out of the cooling channels 3 as the backup plate 1 is manipulated for plating but which can be easily removed from the cooling channels 3 following plating. A preferred material for the filler 4 is wax.

Figure 4:
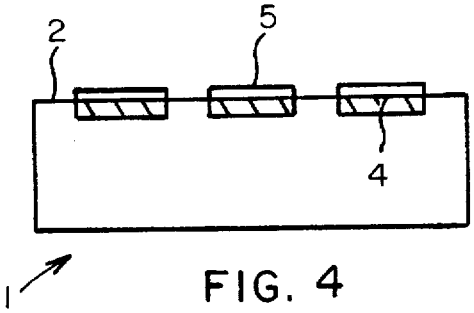

The filler 4 will generally be electrically non-conductive. Thus, as illustrated in FIG. 4, the filler 4 is coated with an electrical conductor 5 such as electrically conductive paint or electrically conductive tape.

The heat-extracting side 2 of the backup plate 1 is now plated with a thermally conductive material, preferably copper. The plating operation can be carried out using conventional electroplating techniques. If desired, the sides of the backup plate 1 other than the heat-extracting side 2 can be masked to prevent deposition of the thermally conductive material.

Figure 5:
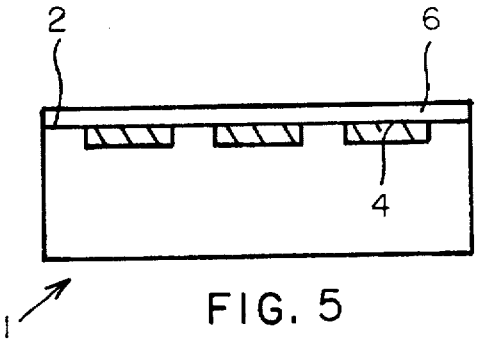

FIG. 5 shows the backup plate 1 with an electrodeposited layer or coating 6 of thermally conductive material. The layer 6 can, for example, have a thickness of 3/32 inch.

Figure 6:
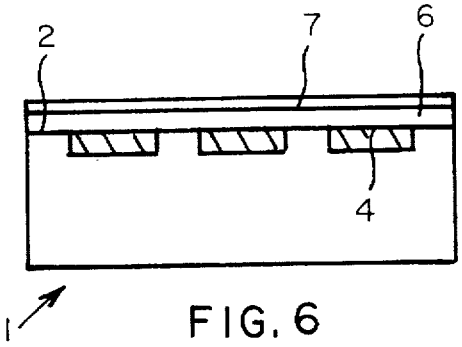
Figure 7:
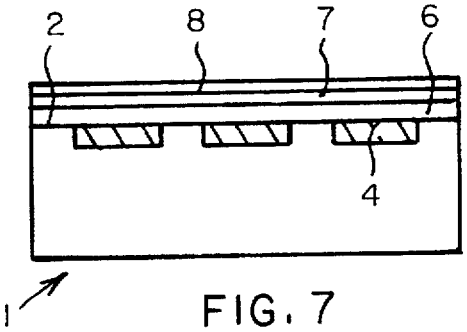

Referring to FIG. 6, a layer or coating 7 can be electroplated onto the thermally conductive layer 6 to serve as a base for a wear-resistant layer or coating 8 shown in FIG. 7. It is preferred for the base layer 7 to consist of nickel and for the wear-resistant layer 8 to consist of chromium, and the nickel and chromium can be applied in thicknesses customary for continuous casting molds. The wear-resistant layer 8 may be electrodeposited onto the base layer 7. Electrodeposition of the base layer 7 and the wear-resistant layer 8 may be performed using conventional techniques.

After application of the wear-resistant layer 8, the filler 4 is removed from the cooling channels 3. If the filler 4 is a material such as wax which melts at a temperature that does not affect the backup plate 1 or one of the layers 6,7,8, removal of the filler 4 from the cooling channels 3 can be accomplished by melting the filler 4. The filler 4 can then flow out of the cooling channels 3.

Figure 8:
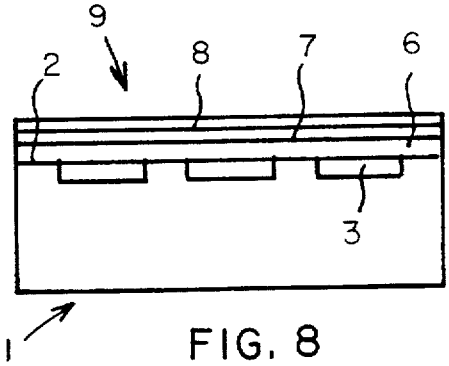

The mold wall obtained when the filler 4 has been removed from the cooling channels 3 is identified by 9 in FIG. 8. The mold wall 9 can, for instance, be assembled with three other mold walls to form a continuous casting mold with a central casting cavity. The wear-resistant layer 8 of the mold wall 9 bounds one side of the casting cavity. The cooling channels 3 of the mold wall 9 are connected to a circulating water system in the usual manner so that the backup plate 1 can extract heat from a continuously cast strand formed in the casting cavity.

Since the cooling channels 3 are located in the backup plate 1 rather than the thermally conductive layer 6, the thermally conductive layer 6 can be relatively thin. This enables the cost of material to be reduced inasmuch as the thermally conductive layer 6 will normally consist of a high grade substance whereas the backup plate 1 can be made of a relatively low grade substance. Furthermore, by plating the thermally conductive layer 6 onto the backup plate 1, the invention eliminates the need to bolt the thermally conductive layer 6 to the backup plate 1. This is also of importance in holding down the thickness of the thermally conductive layer 6 because the thermally conductive layer 6 does not have to serve as an anchor for bolts.

Machining of the cooling channels 3 into the backup plate 1 prior to plating greatly simplifies the production of the cooling channels 3 as opposed to drilling or boring through a solid body as in the prior art. Moreover, machining of the cooling channels 3 prior to plating permits the cooling channels 3 to be made relatively wide and shallow thereby allowing the cooling efficiency to be increased.

Figure 9:
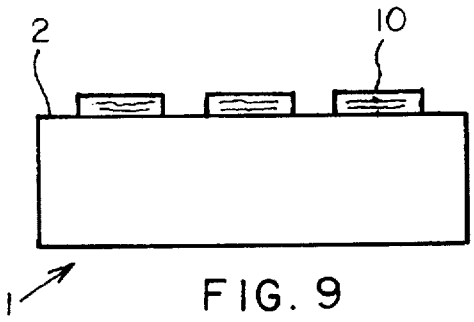

The cooling channels 3 can also be formed without machining. In this embodiment of the invention, cores 10 constituting negatives of the cooling channels 3 are applied to the major side 2 of the backup plate 1 at the intended locations of the cooling channels 3. This is illustrated in FIG. 9. The widths and heights of the cores 10 correspond to the desired widths and depths of the cooling channels 3. The cores 10, which are preferably electrically non-conductive, may be adhesively secured to the backup plate 1. The cores 10 can, for instance, consist of plastic strips.

Figure 11:
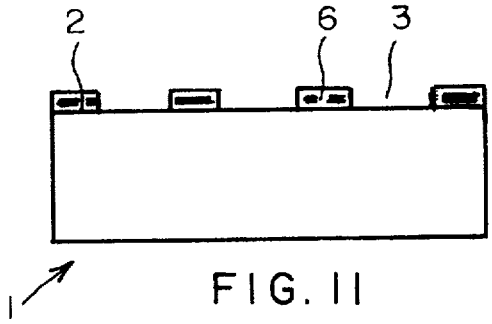
Figure 10:
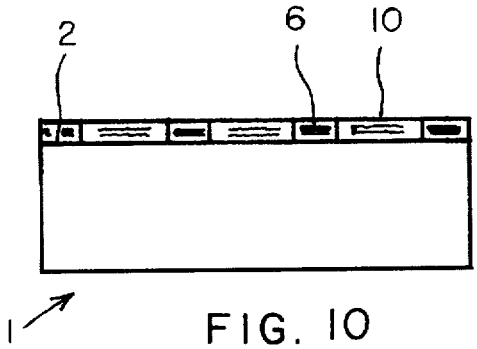
Figure 12:
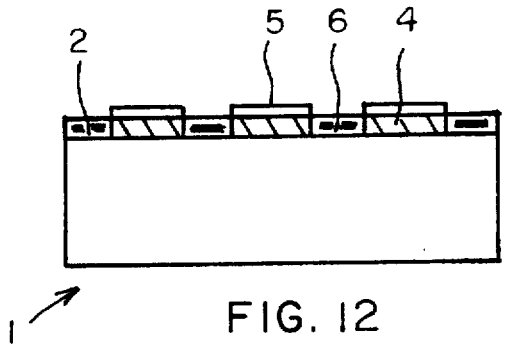

Following application of the cores 10 to the backup plate 1, thermally conductive material constituting part of the thermally conductive layer 6 is plated onto the major side 2 of the backup plate 1 around the cores 10. When the thickness of the thermally conductive material equals the height of the cores 10, the plating operation is stopped. FIG. 10 shows the condition of the backup plate 1 at this time. The cores 10 are now removed as illustrated in FIG. 11 to form the cooling channels 3. With reference to FIG. 12, the cooling channels 3 are filled with the filler 4 which is coated with the electrical conductor 5 as described previously.

Figure 13:
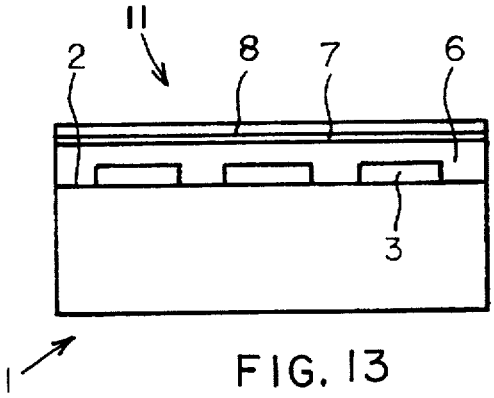

Plating of the thermally conductive material is resumed and continues until the thermally conductive layer 6 has been formed. The base layer 7 and wear-resistant layer 8 are thereupon sequentially deposited over the thermally conductive layer 6 as outlined earlier. Upon completion of plating, the filler 4 is removed from the cooling channels 3 to yield the mold wall 11 shown in FIG. 13.

The invention can be used not only to produce new mold walls but also to refurbish used mold walls. Thus, when the thermally conductive layer of a mold wall has been worn down to a predetermined thickness below which the mold wall should no longer be in service, fresh thermally conductive material, as well as a fresh base layer and a fresh wear-resistant layer, can be plated over the worn thermally conductive layer.

Various modifications can be made within the meaning and range of equivalence of the appended claims.

I claim:

1. A method of making a mold, comprising the steps of providing a carrier; applying a core to said carrier; plating thermally conductive material onto said carrier in the regions of opposed locations of said core; and removing said core from said carrier thereby form a channel running through said thermally conductive material.

2. The method of claim 1, wherein said thermally conductive material comprises copper.

3. The method of claim 1, further comprising the step of plating a wear-resistant material over said thermally conductive material.

4. The method of claim 3, further comprising the step of plating a base material for said wear-resistant material over said thermally conductive material, said wear-resistant material being plated over said base material.

5. The method of claim 4, wherein said thermally conductive material comprises copper, said base material comprises nickel, and said wear-resistant material comprises chromium.

6. The method of claim 1, wherein said carrier comprises steel.

7. The method of claim 1, wherein the plating step comprises electroplating.

8. The method of claim 1, wherein said core is a strip.

9. The method of claim 1, wherein said core comprises plastic.

10. The method of claim 1, wherein said core is substantially non-conductive.

11. The method of claim 1, wherein the applying step comprises adhesively securing said core to said carrier.

12. The method of claim 1, wherein the plating step is interrupted prior to completion thereof and the core removing step is performed following interruption of the plating step; and further comprising the steps of placing a filler in said channel subsequent to the core removing step, resuming the plating step subsequent to the placing step, and removing said filler from said channel subsequent to the plating step.

13. The method of claim 12, wherein the plating step is interrupted when the thickness of said thermally conductive material equals or approximates the height of said core.

14. The method of claim 12, further comprising the step of coating said filler with an electrical conductor prior to the plating step.

15. The method of claim 14, wherein said conductor comprises electrically conductive paint or electrically conductive tape.

16. The method of claim 12, wherein the filler removing step comprises causing said filler to flow out of said channel.

17. The method of claim 12, wherein the filler removing step comprises melting said filler.

18. The method of claim 17, wherein said filler comprises wax.

* * * * *